US005701346A

United States Patent [19]

Herre et al.

[11] Patent Number: 5,701,346

[45] Date of Patent: Dec. 23, 1997

[54] METHOD OF CODING A PLURALITY OF AUDIO SIGNALS

[75] Inventors: Jürgen Herre, Buckenhof; Berhard Grill, Lauf; Ernst Eberlein, Grossenseebach; Karlheinz Brandenburg, Erlangen; Dieter Seitzer, Erlangen, all of Germany

[73] Assignee: Fraunhofer-Gesellschaft zur Forderung der Angewandten Forschung e.V., Munich, Germany

[21] Appl. No.: 704,730

[22] PCT Filed: Feb. 2, 1995

[86] PCT No.: PCT/EP95/00378

§ 371 Date: Sep. 12, 1996

§ 102(e) Date: Sep. 12, 1996

[87] PCT Pub. No.: WO95/26083

PCT Pub. Date: Sep. 28, 1995

[30] Foreign Application Priority Data

Mar. 18, 1994 [DE] Germany ..... 440 93 68.3

[51] Int. Cl.[6] ..... H04S 5/02

[52] U.S. Cl. ..... 381/18; 381/23

[58] Field of Search ..... 381/1, 17, 18, 381/22, 23, 2; 395/2.38

[56] References Cited

U.S. PATENT DOCUMENTS 5,291,557 3/1994 Davis et al. ..... 381/22

FOREIGN PATENT DOCUMENTS 0574145 12/1993 United Kingdom .

OTHER PUBLICATIONS

International Search Report of the PCT/EP95/00378.

International Standard ISO/IEC 11172-3, 1993, pp. V, VI, 5, 6 (English translation).

Stettner: Mehrkanal-Stereoton zum Bild fur Kino und Fernsehen, In: Rundfunktechnische Mitteilungen, edition 35 1991, vol. 1, pp.1-9.

IEEE International Conf. on Acoustics, Speech and Processing, vol. 2, Mar. 23, 1992, San Francisco, California, U.S.A., pp. 205-288, "Matrixing of bit rate reduced audio signals," (English translation).

*Primary Examiner*—Forester W. Isen

*Attorney, Agent, or Firm*—Wolf, Greenfield & Sacks, P.C.

[57] ABSTRACT

In a method of coding a plurality of audio signals, the left and the right basic channel as well as the central channel are combined by joint stereo coding so as to obtain a jointly coded signal, which is decoded so as to provide simulated decoded signals. The simulated decoded signals and two surround channels are combined by matricization by means of a compatibility matrix so as to form compatible signals which are suitable for decoding by existing decoders. In order to avoid audible disturbances caused by excessive energy contents of the compatible signals, which would occur if joint stereo coding and decoding were carried out prior to carrying out the matricization, the compatible signals or the simulated decoded signals are dynamically weighted by means of a dynamic correction factor in such a way that the compatible signals are approximated with regard to their energy to the energy of signals which would be obtained if the two basic channels and the central channel as well as the surround channels were matricized directly.

11 Claims, 8 Drawing Sheets

METHOD OF CODING A PLURALITY OF AUDIO SIGNALS

FIELD OF THE INVENTION

The present invention refers to a method of coding a plurality of audio signals, comprising the steps of combining at least two signals by joint stereo coding so as to obtain a jointly coded signal, whereupon the jointly coded signal is decoded so as to provide simulated decoded signals, which are combined by matricization in a compatibility matrix together with additional signals so as to provide signals that are compatible with existing decoders.

The present invention especially deals with a multichannel coding technique for audio signals which is adapted to be used in connection with the coding standard MPEG-2.

DESCRIPTION OF THE PRIOR ART

The future MPEG-2 audio standard does not represent a fundamentally new coding algorithm, but defines extensions of the coding algorithms according to the standards MPEG-1 layer I, II and III. Although MPEG-1 decoders are not capable of decoding an MPEG-2 bit stream, the extension to a multichannel system including up to 5 full-range audio channels with an additional low-frequency channel and up to 7 multispeech channels permits a so-called downward compatibility for MPEG-1 standard decoders.

When MPEG-2 coding for several audio channels is carried out, one central channel, one left and one right basic channel and one left as well as one right so-called "surround" channel are typically coded, a low-frequency improvement channel for the independent transmission and reproduction of low-frequency information being selectively provided.

When the MPEG-2 standard is used, importance is attached to a so-called "downward compatible" transmission, i.e. the coding is to be carried out such that the coded signal can be decoded by already existing dual-channel decoders of the MPEG-1 standard. For this purpose, the left and right basic channels L, R of the MPEG-1 standard are replaced by matricized signals Lc, Rc that are produced by a compatibility matrix. The left compatible signal Lc is obtained from the left basic channel, the central channel and the left surround channel by multiplying these signals with different matrix coefficients and by adding them afterwards. The bit stream thus produced is adapted to be decoded by an MPEG-1 decoder, the central information and the surround information being, however, not contained separately in the MPEG-1-decodable compatible signals Lc, Rc.

The dual-channel signal obtained by matricization includes all relevant signal components for permitting downward-compatible decoding. Hence, it will suffice in most cases to transmit, in addition to these compatible signals, three further channels within the framework of the multichannel extension data stream. The missing up to two channels are reconstructed in the decoder by inverse matricization, or a so-called dematricization.

For utilizing the multichannel irrelevance, joint stereo decoding techniques are used, such as joint stereo coding which is based on the "intensity stereo coding technique". All jointly coded signals are replaced by scaled embodiments of a single transmitted signal. This is done in such a way that the acoustically relevant signal properties, viz. e.g. the energy or the time envelopes of the signals, are largely preserved.

The production of downward compatible signals and the simultaneous utilization of multichannel irrelevance by using joint stereo coding techniques entail, however, the following problems: When the compatible signals Lc, Rc are produced first by matricization and when "intensity stereo" coding, or IS coding, is then applied to the residual channels, these signals are no longer in harmony with the "compatible" signals. Hence, a dematricization operation in the decoder will result in completely different reconstructed channel signals which are audibly distorted in comparison with the original signals.

This problem can be solved by using IS coding first and by producing the compatible signals by matricization subsequently. This enforces the consistency of all signals taking part and, consequently, it has the effect that correct dematricized channels are obtained.

The known coding method, which has been explained hereinbefore and which applies IS coding first, whereupon the compatible signals are produced by matricization, will be explained hereinbelow making reference to FIGS. 4*a* to 4*c*, which show the structure and the mode of operation of a known encoder and of a known decoder.

As can be seen in FIG. 4*a*, the encoder has five input channels, viz. a left and a right basic channel L, R, a central channel C as well as a left and a right surround channel Ls, Rs. The left and the right basic channels L, R as well as the central channel C are subjected to joint stereo coding in a first block 1, said joint stereo coding resulting in a jointly coded signal y. After quantization in a quantization block 2*a*, this signal is supplied to a block 3, which packs the bit stream, i.e. which arranges the respective signals and information within the bit stream in accordance with the standard.

The jointly coded signal y is additionally supplied to a fourth block 4, which carries out joint stereo decoding of this signal so as to provide simulated decoded signals L', R', C' for the left and right basic channels as well as the central channel. These simulated decoded signals L', R', C' as well as the left and right surround channels Ls, Rs are supplied to a compatibility matrix 5, which produces the left and right compatible signals Lc', Rc'. After having been quantized in blocks 2*b*, 2*c*, these signals are also supplied to the third block 3 for packing the bit stream.

In FIG. 4*b*, the joint stereo decoder is shown, which is a constituent part of the decoder shown in FIG. 4*c*. The last-mentioned decoder comprises a block 6 for unpacking the bit stream, said block 6 being followed by a plurality of blocks 7*a*, 7*b*, 7*c* whose function is inverse to the function of blocks 2*a* to 2*c* and which produce on the output side thereof the jointly coded signal y, the left compatible signal Lc' and the right compatible signal Rc'. The jointly coded signal y is subjected to joint stereo decoding within the block 8 so as to produce the decoded signals L', R' for the left and right basic channels as well as the decoded signal C' for the central channel. The last-mentioned signals are supplied, together with the two compatible signals Lc', Rc', to an inverse compatibility matrix 9 by means of which the missing channels, viz. the left and right surround channels Ls', Rs', are regained.

SUMMARY OF THE INVENTION

The present invention is, however, based on the finding that, although this course of action, where IS coding is applied first and the compatible signals are produced by matricization afterwards, enforces the consistency of all signals taking part and has, consequently, the effect that correct dematricized channels are obtained, it causes a changed coherence of the signals taking part in the IS coding, whereby audible disturbances of the compatible channels Lc, Rc may be caused under certain circumstances.

The present invention is based on the finding that the original signals can normally be regarded as uncorrelated signals so that their energies will be summed up in a "genuine" compatible signal. If, however, the course of action just explained is taken, where IS coding is carried out first and the compatible signals Lc, Rc are produced by matricization afterwards, the amplitudes will be summed up due to the complete coherence of the signals so that, normally, a signal having a substantially higher energy will be produced.

A method for matrixing of bit rate reduced audio signals is described in the article "Matrixing of bit rate reduced audio signals", W. R. TH. Ten Kate et al in IEEE INTERNATIONAL CONFERENCE ON ACOUSTICS, SPEECH AND SIGNAL PROCESSING, vol. 2, Mar. 23, 1992, San Fransisco, Calif., U.S.A., pp. 205–208. This article discloses a bit rate reduction, in which the quantization noise can not be observed. This is achieved by using a quantization in a sub band region and by using an adaptive bit allocation scheme.

The above mentioned article relates further to the stereo compatible transmission of the surround sound by means of the "Hidden Channel Technique". This technique is used to add non-audible information which can not be heard to an audio signal. The matricization coefficients are in this case selected such that the matrix can be inverted. It is thought of the use of fixed coefficients as well as the use of variable coefficients.

It is therefore the object of the present invention to further develop a method of coding a plurality of audio signals of the type mentioned at the beginning in such a way that, although joint stereo coding techniques are applied to at least part of the stereo signals to be coded, the compatible signals produced by matricization do not entail any audible disturbances.

This object is achieved by a method of coding a plurality of audio signals, comprising the steps of:

combining at least two signals by joint stereo coding so as to obtain a jointly coded signal, decoding the jointly coded signal so as to provide simulated decoded signals, combining the simulated decoded signal and at least one additional signal so as to provide signals that are compatible with existing decoders, said simulated decoded signal and said at least one additional signal being combined in a compatibility matrix by matricizing, and dynamic weighting of either the compatible signals or the simulated decoded signals by means of at least one dynamic correction factor so as to approximate the compatible signals with regard to their acoustically relevant signal properties to the signals which would be produced if these at least two signals and the additional signal were directly matricized by means of this compatibility matrix.

A dynamic rescaling or a modification of the matricizing/dematricizing operation is carried out by dynamic weighting of the compatible signals or of the simulated decoded signals by means of at least one dynamic correction factor so as to approximate the compatible signals with regard to their acoustically relevant signal properties, viz. preferably with regard to their energies or also their time envelopes, to the respective signal properties, viz. again preferably the energies or the time envelopes, of the signals which would be produced if the signals were directly matricized (without joint stereo coding) by means of the compatibility matrix.

BRIEF DESCRIPTION OF THE DRAWINGS

Preferred embodiments of encoders and decoders used for carrying out exemplary methods of encoding and decoding according to the present invention will be explained in detail making reference to the drawings enclosed, in which.

DESCRIPTION OF PREFERRED EMBODIMENTS OF THE INVENTION

Figure 1A:
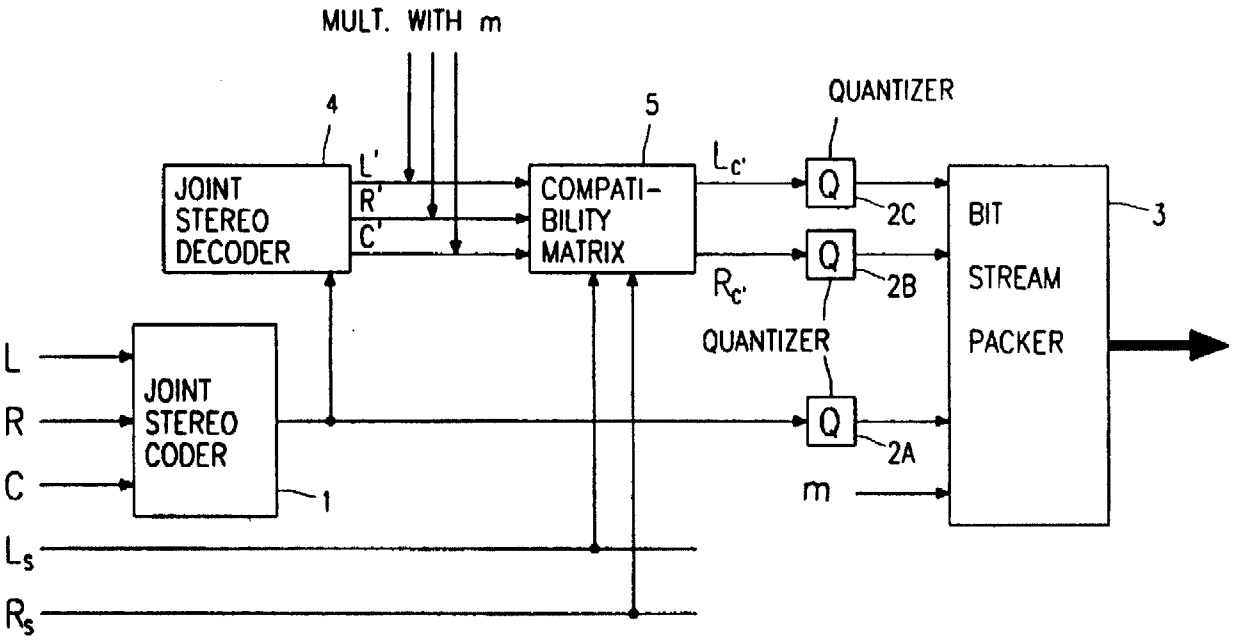
FIG. 1*a* shows an encoder according to a first embodiment.
Figure 4A:
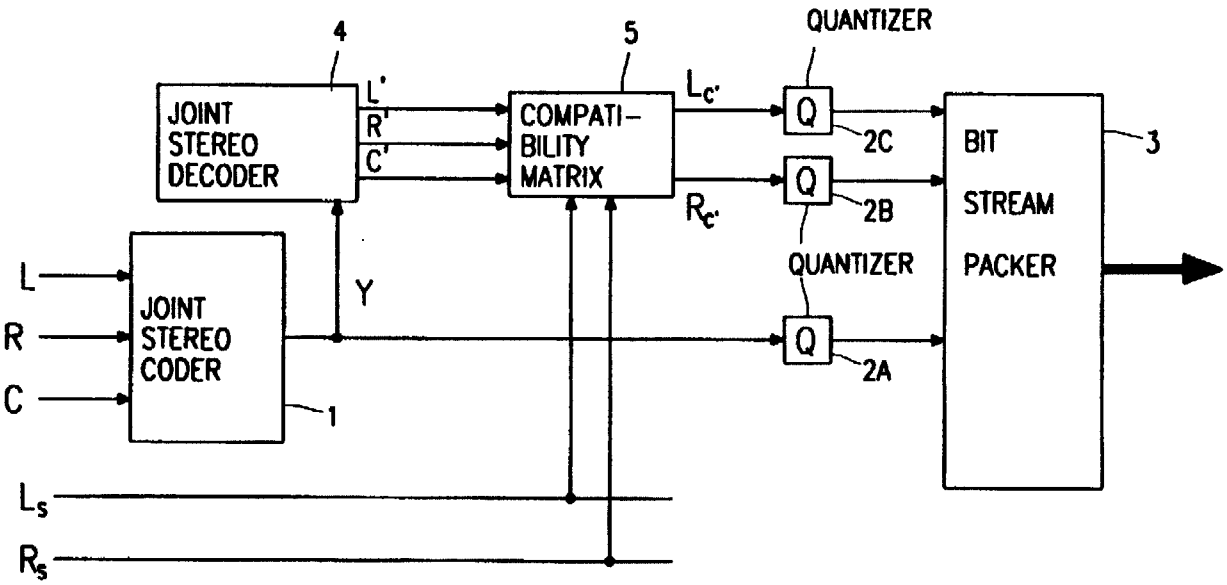
FIG. 4A (PRIOR ART)
FIG. 4*a* shows a block diagram of a known encoder.

The first embodiment of an encoder according to the present invention, which is used for carrying out the coding method according to the present invention and which will be explained hereinbelow making reference to FIG. 1*a*, corresponds, with the exception of the deviations explained hereinbelow, to the embodiment of the known encoder described with reference to FIG. 4*a*. Identical or corresponding components and blocks, respectively, are designated by corresponding reference numerals.

Figure 1B:
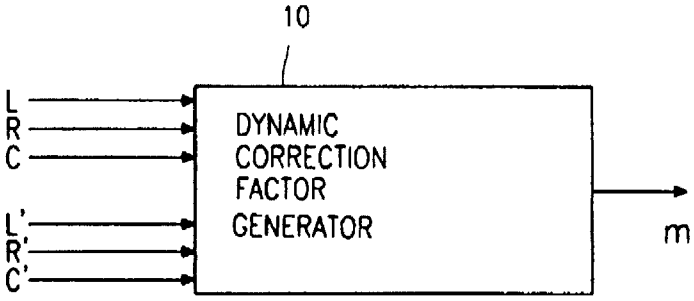
FIG. 1*b* shows a block diagram of a circuit for obtaining a dynamic correction factor.

As can clearly be seen in FIG. 1*b*, the encoder according to the present invention comprises a circuit 10 for calculating a single dynamic correction factor m, said circuit 10 having supplied thereto the following input signals: the left and right basic channels L, R as well as the central channel C as well as the simulated decoded right and left basic channels L-, R- produced by joint stereo coding within block 1 and by subsequent joint stereo decoding within block 4 as well as the simulated decoded central channel C-. This embodiment of the present invention aims at achieving an adaptation of the acoustically relevant signal properties with regard to the energies of the contrasting signals L, R, C and L-, R-, C-. It follows that the compatible signals should achieve energy preservation as compared to "genuine" compatible signals. For this purpose, the circuit 10 calculates the single dynamic correction factor m according to the following relationship:

$$m=\sqrt{\frac{|a\cdot L+a\cdot R+b\cdot C|^2}{|a\cdot L'+a\cdot R'+b\cdot C'|^2}} \tag{1}$$

By means of this common correction factor, each of the simulated decoded signals L-, R-, C- is weighted at the output of block 4 (by means of a multiplier which is not shown) prior to supplying the thus dynamically scaled signals L-, R-, C- to the compatibility matrix 5. The compatibility matrix calculates the compatible signals Lc', Rc' according to the following equations:

$$Lc'=a\cdot L'+b\cdot C'+c\cdot Ls'; \quad (2)$$

$$Rc'=a\cdot R'+b\cdot C'+c\cdot Rs';$$

Figure 1C:
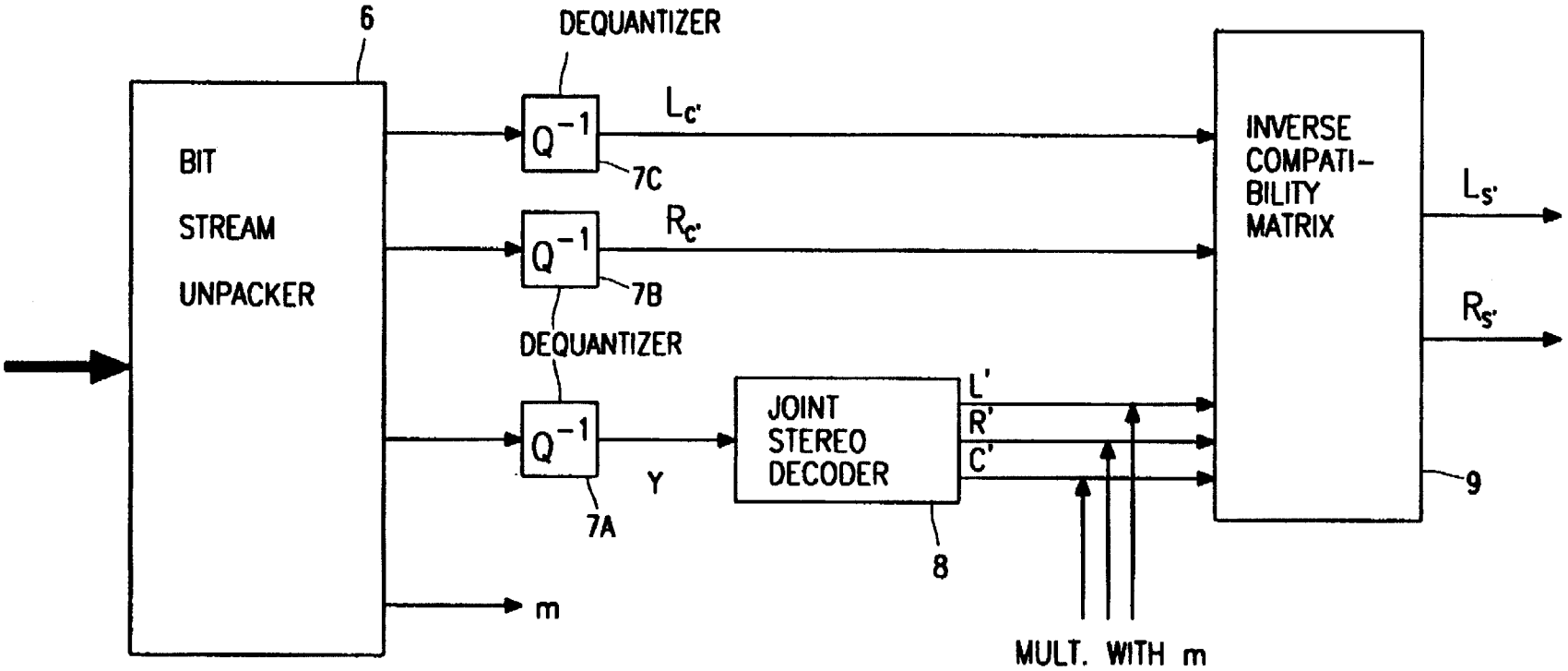
FIG. 1*c* shows a first embodiment of a decoder.

The dynamic correction factor m is transmitted to the decoder as side information within the signal packed by block 3, said decoder being shown in FIG. 1*c*.

Figure 4B:
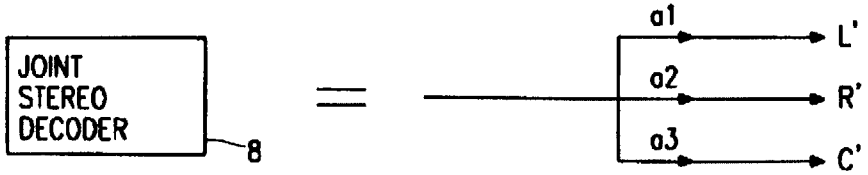
FIG. 4B (PRIOR ART)
FIG. 4*b* shows a diagram for elucidating the function of a joint stereo decoder.
Figure 4C:
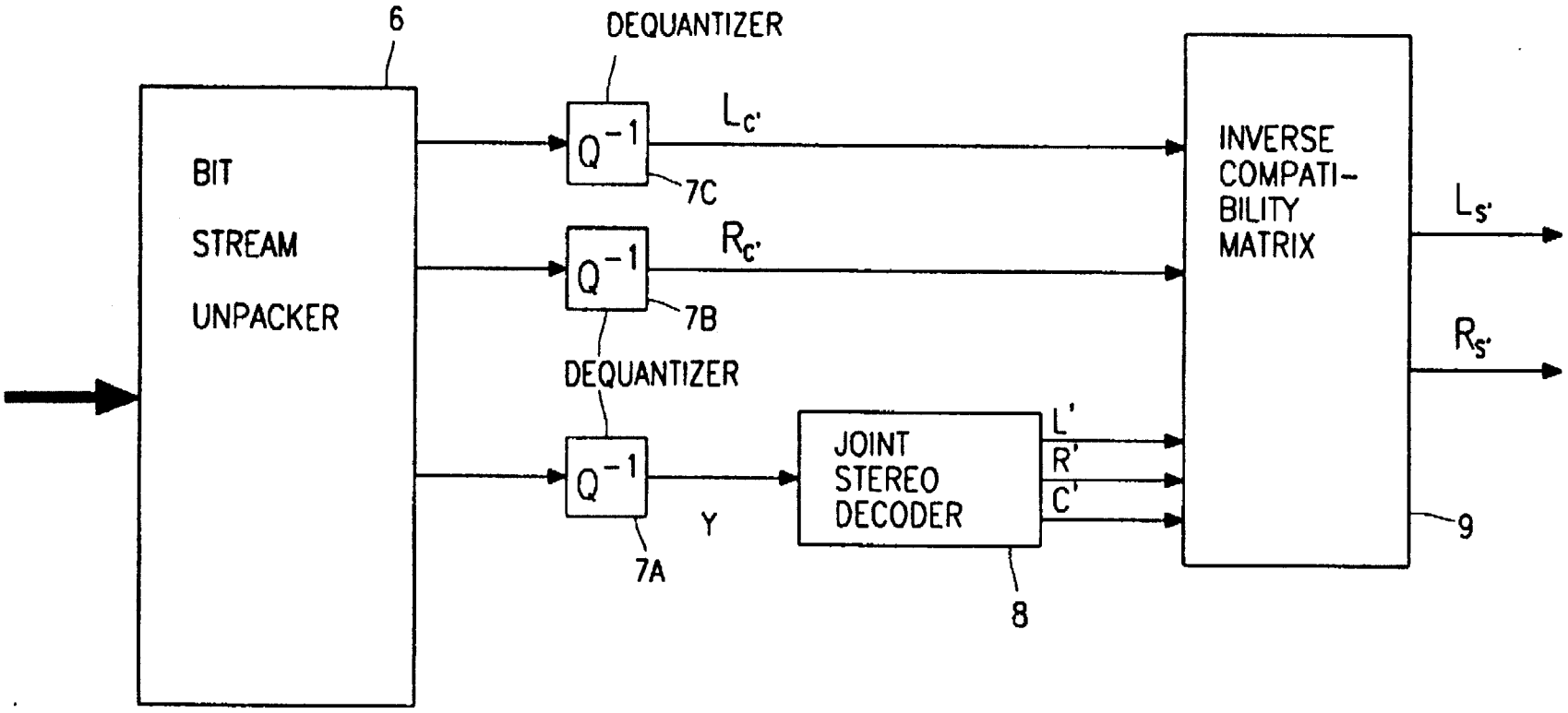
FIG. 4C (PRIOR ART)
FIG. 4*c* shows a block diagram of a known decoder.

In addition to the functions which have already been explained with reference to FIG. 4*c*, block 6, which is used for unpacking the bit stream, supplies the correction factor m which is transmitted as side information.

The decoded signals L', R', C' for the left and right channels as well as for the central channel, which are produced by block 8 used for carrying out the joint stereo decoding of the jointly coded signal y, are multiplied (by means of multipliers which are not shown) by this dynamic correction factor prior to supplying the thus obtained weighted signals to the inverse compatibility matrix 9 together with the left and right compatible signals Lc', Rc', said inverse compatibility matrix 9 calculating on the basis of the signals supplied thereto the left and right surround channels Ls', Rs' according to the following equations of the inverse compatibility matrix:

$$Ls'=(Lc'-a\cdot L'-b\cdot C')/c \quad (3)$$

$$Rs'=(Rc'-a\cdot R'-b\cdot C')/c$$

In the above equation, a and b as well as c stand for coefficients of the inverse compatibility matrix.

In the first embodiment described hereinbefore, only a single dynamic correction factor is used; by means of said correction factor, it is only possible to achieve a certain approximation of the short-term energy characteristics in the compatible signals to the energy condition which said signals would have in the ideal case, said ideal case being that these signals would be matricized directly by the compatibility matrix without previous joint coding and decoding. In view of the fact that, in real systems, the block time of the channels is in the range of 10 ms, this value being a value that depends on the sampling frequency and on the coding system, this solution may be too coarse from the psychoacoustic point of view. The solutions explained hereinbelow permit a more far-reaching optimization for achieving energy preservation in the compatible signals Lc', Rc'.

Figures 2A, 2B:
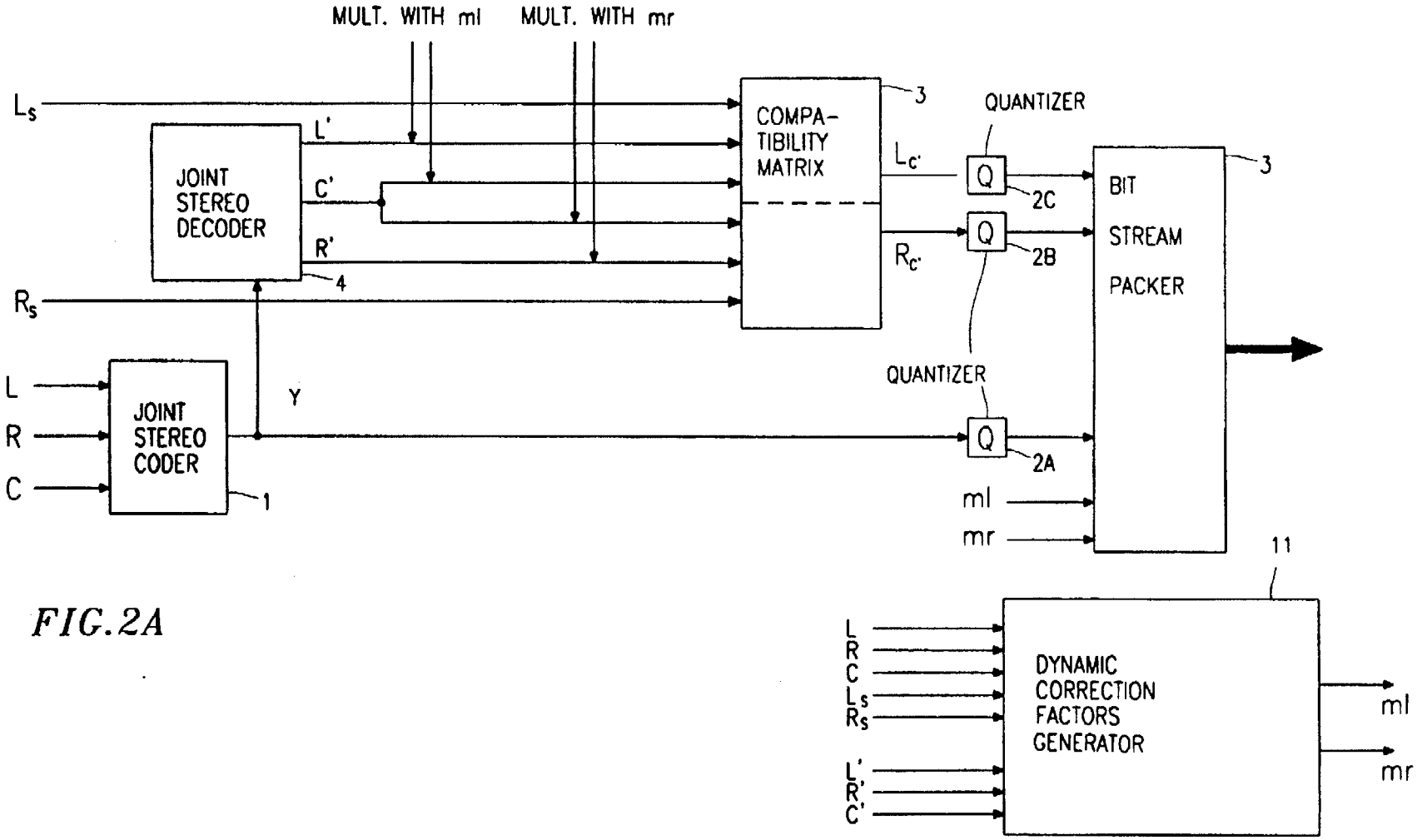
FIG. 2*a* shows a second embodiment of an encoder.
FIG. 2*b* shows a block diagram of a second embodiment of a circuit for obtaining two dynamic correction factors.
Figure 2C:
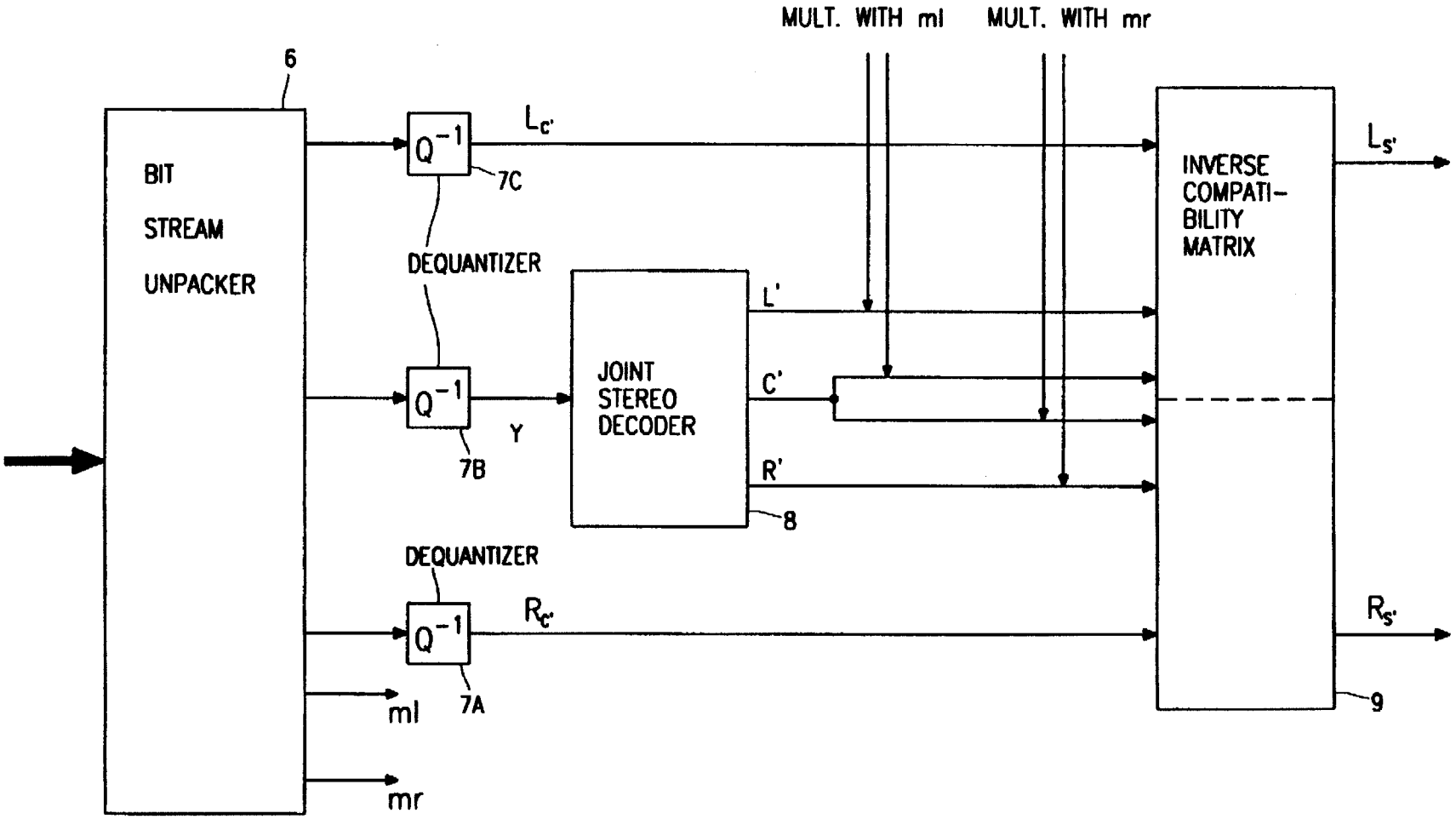
FIG. 2*c* shows a second embodiment of a decoder.

In the second embodiment of the encoder and decoder according to the present invention, which is shown in FIG. 2*a* and 2*c*, the structures and functions described with reference to FIG. 4 and 1, respectively, are used in a corresponding manner—with the exception of the differences explained herebelow—so that identical or comparable circuit blocks are designated by corresponding reference numerals.

The encoder according to FIG. 2*a* works with a circuit 11 for calculating two dynamic correction factors ml, mr on the basis of the left and right basic channels L, R, the central channel C, the left and right surround channels Ls, Rs as well as on the basis of the simulated decoded signals L', R', C' for the left channel, the right channel and the central channel, the left and right correction factors ml, mr satisfying the following equations:

$$|a\cdot L+b\cdot C+c\cdot Ls|^2=|ml\cdot(a\cdot L'+b\cdot C')+c\cdot Ls|^2 \quad (4)$$

$$|a\cdot R+b\cdot C+c\cdot Rs|^2=|mr\cdot(a\cdot R'+b\cdot C')+c\cdot Rs|^2$$

The simulated decoded left channel L' as well as the simulated decoded central channel are multiplied by the left correction factor ml (by means of multipliers which are not shown), whereas the simulated decoded central channel C' and the simulated decoded right channel R' are multiplied by the right correction factor mr (by means of multipliers which are not shown), prior to supplying the thus dynamically weighted signals to the compatibility matrix 3 together with the left surround channel Ls and the right surround channel Rs. Said compatibility matrix 3 corresponds to the above-explained compatibility matrix (cf. equation 2) with the exception of the fact that, for calculating the left compatible signal Lc', only the central signal weighted with the left correction factor ml is used, and vice versa.

Also in this embodiment, the left and right correction factors ml, mr are supplied as a side information to the circuit 3 for packing the bit stream and regained by the circuit 6 for unpacking the bit stream. (Cf. FIG. 2).

After the joint stereo decoding in block 8, the decoded left channel L' and the decoded central channel C' are, on the one hand, multiplied by the left correction coefficient ml (by means of multipliers which are not shown), whereas, on the other hand, the decoded central channel C' and the decoded right channel R' are weighted with the right correction coefficient mr, prior to supplying the signals thus obtained together with the two decoded compatible signals Lc', Rc' to the inverse compatibility matrix 9 so as to regain the left and right surround channels Ls', Rs'.

Figure 3A:
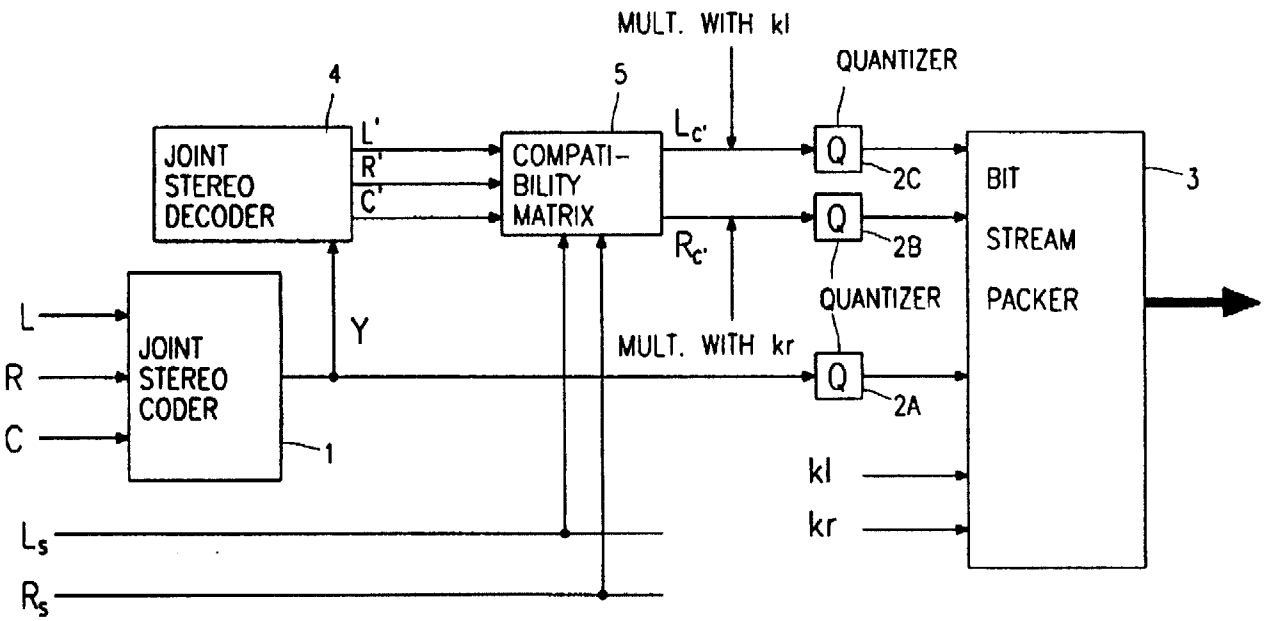
FIG. 3*a* shows a third embodiment of an encoder.
Figure 3B:
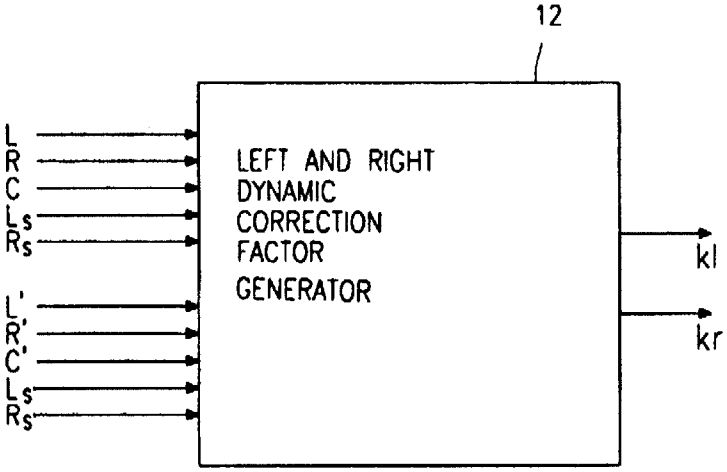
FIG. 3*b* shows a block diagram of a third embodiment of a circuit for obtaining two dynamic correction factors.

In the third embodiment of the encoder and decoder according to the present invention, which will now be described making reference to FIGS. 3*a* to 3*c*, a left and a right dynamic correction factor kl, kr are calculated by circuit 12 in accordance with the following equations:

$$kl=\sqrt{\frac{|a\cdot L+b\cdot C+c\cdot Ls|^2}{|a\cdot L'+b\cdot C'+c\cdot Ls'|^2}} \quad (5)$$

$$kr=\sqrt{\frac{|a\cdot R+b\cdot C+c\cdot Rs|^2}{|a\cdot R'+b\cdot C'+c\cdot Rs'|^2}}$$

In the above equation, a, b and c again stand for factors of the compatibility matrix used in block 3. The left and right correction factors kl, kr are used to multiply (by means of multipliers which are not shown) the left and right compatible signals Lc', Rc' at the output of the compatibility matrix. These correction factors are, in turn, supplied to block 3 used for packing the bit stream, said block 3 transmitting these correction factors as side information to the decoder, which is shown in FIG. 3*c*.

Figure 3C:
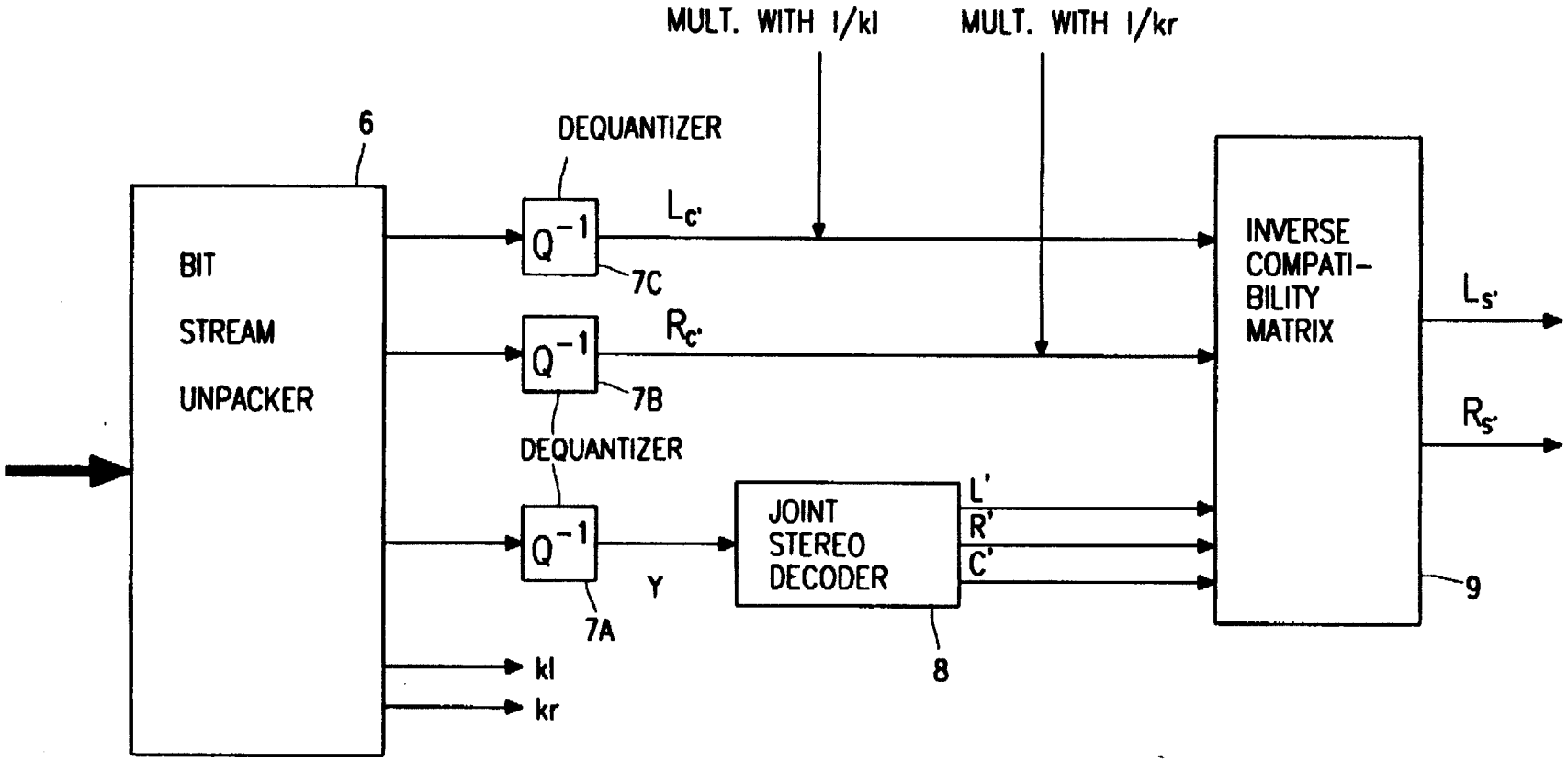
FIG. 3*c* shows a third embodiment of a decoder.

Block 6, which is shown in said FIG. 3*c* and which is used for unpacking the bit stream, again supplies the two correction factors kr, kl. The decoded left and right compatible signals Lc', Rc' are multiplied (by means of multipliers which are not shown) by their respective reciprocal 1/kl; 1/kr, prior to supplying the thus weighted signals to the inverse compatibility matrix 9 together with the decoded left and right channels L', R' and the decoded central channel C' for regaining the left and right surround channels Ls', Rs'.

The embodiment described hereinbefore refers to the special application of extended multichannel audio coding according to the MPEG 2 standard. To the person skilled in the art, it will be obvious that the teachings of the present invention can be used wherever at least two signals are combined by joint stereo coding so as to form one coded signal and where said coded signal is used for obtaining therefrom simulated decoded signals which are combined with additional signals in a compatibility matrix so as to form compatible signals.

In the embodiments described hereinbefore, the dynamic correction factors are calculated such that there will be energy preservation of the compatible signals in comparison with the signals that would be obtained as a result of direct application to the compatibility matrix without previous joint stereo coding. It is, however, also possible to use criteria other than energy preservation for calculating the dynamic correction factors. For example, instead of considering squared signals, it would also be possible to use other exponents than 2 for taking into consideration energy preservation.

Furthermore, it is possible to adapt the signals to one another with regard to their time envelopes. In short, an appropriate selection of the correction factor permits the compatible signals to be adapted with regard to any kind of acoustically relevant signal properties to the signals which would be obtained if the compatibility matrix were applied to signals which have not been subjected to joint stereo coding and subsequent decoding.

In addition, reference is made to the fact that the teaching of the present invention is not limited to a special number of channels, but can be applied to any kind of multichannel audio systems.

We claim:

1. A method of coding a plurality of audio signals, comprising the steps of:

combining at least two signals by joint stereo coding so as to obtain a jointly coded signal, decoding the jointly coded signal so as to provide simulated decoded signals, combining the simulated decoded signal and at least one additional signal so as to provide signals that are compatible with existing decoders, said simulated decoded signal and said at least one additional signal being combined in a compatibility matrix by matricizing, and dynamic weighting of either the compatible signals or the simulated decoded signals by means of at least one dynamic correction factor so as to approximate the compatible signals with regard to their acoustically relevant signal properties to the signals which would be produced if these at least two signals and the additional signal were directly matricized by means of this compatibility matrix.

2. A method according to claim 1, wherein the step of dynamically weighting the compatible signals or the simulated decoded signals by means of the dynamic correction factor is carried out such that the compatible signals are, with regard to their energy, approximated to the energy of the signals which would be produced if these at least two signals and the additional signal were directly matricized by means of the compatibility matrix.

3. A method according to claim 1, wherein the step of joint stereo coding comprises jont stereo coding of the left and of the right basic channel and of the central channel, and wherein the additional signals correspond to the left and to the right surround channel.

4. A method according to claim 3, wherein the compatibility matrix is as follows:

$$Lc=a\cdot L+b\cdot C+c\cdot Ls;$$

$$Rc=a\cdot R+b\cdot C+c\cdot Rs;$$

wherein Ls and Rs stand for the left and right surround channels, L and R stand for the left and right basic channels, C stands for the central channel, a, b and c stand for the coefficient of the compatibility matrix and Lc, Rc stand for the compatible signals.

5. A method according to claim 1, wherein a single dynamic correction factor is calculated on the basis of the at least two signals, which are to be subjected to joint stereo coding, and on the basis of at least part of the simulated decoded signals, and wherein each of the simulated decoded signals is multiplied by this dynamic correction factor prior to its matricization.

6. A method of decoding the audio signals coded according to claim 5, wherein the correction factor is transmitted to the decoder, the jointly coded signal is subjected to joint stereo decoding so as to obtain the decoded left and right basic channels as well as the decoded central channel, the decoded left and right basic channels as well as the decoded central channel are weighted with the correction factor by multiplication, and that the thus weighted signals are matricized together with the compatible signals by means of an inverse compatibility matrix so as to regain the left and right surround channels.

7. A method according to claim 6, wherein the single dynamic correction factor m is determined according to the following relationship:

$$m=\sqrt{\frac{|a\cdot L+a\cdot R+b\cdot C|^2}{|a\cdot L'+a\cdot R'+b\cdot C'|^2}}$$

wherein L and R stand for the left and right basic channels, C stands for the central channel, a and b stand for coefficients of the compatibility matrix, and L' and R' stand for simulated decoded right and left basic channels produced by joint stereo coding and joint stereo decoding.

8. A method according to claim 4, wherein two dynamic correction factors ml, mr are determined such that the following equations are fulfilled:

$$|a\cdot L+b\cdot C+c\cdot Ls|^2=|ml\cdot(a\cdot L'+b\cdot C')+c\cdot Ls|^2$$

$$|a\cdot R+b\cdot C+c\cdot Rs|^2=|mr\cdot(a\cdot R'+b\cdot C')+c\cdot Rs|^2$$

wherein Ls, Rs stand for the left and right surround channels, L and R stand for the left and right basic channels, C stands for the central channel, a, b and c stand for coefficients of the compatibility matrix, and Lc', Rc' stand for the compatible signals, and the simulated decoded left channel obtained by joint stereo coding and subsequent joint stereo decoding as well as the simulated decoded central channel are weighted with one of the correction factors and the simulated decoded right channel obtained by joint stereo coding and subsequent joint stereo decoding as well as the simulated decoded central channel are weighted with the other correction factor prior to being matricized by means of the compatibility matrix together with the left and right surround channels so as to provide the compatible signals.

9. A method of decoding the audio signals coded according to claim 8, wherein the two correction factors are transmitted to the decoder, the jointly coded signal is subjected to joint stereo decoding so as to obtain the decoded left and right basic channels as well as the decoded central channel, the decoded left basic channel and the decoded central channel are weighted with one of the correction factors by multiplication and the decoded central channel as well as the decoded right basic channel are weighted with the other correction factor by multiplication, and that the thus weighted signals are matricized by means of an inverse compatibility matrix together with the compatible signals so as to regain the right and left surround channels.

10. A method according to claim 4, wherein two dynamic correction factors kl, kr are determined such that the following equations are fulfilled:

$$kl=\sqrt{\frac{|a\cdot L+b\cdot C+c\cdot Ls|^2}{|a\cdot L'+b\cdot C'+c\cdot Ls'|^2}}$$

$$kr=\sqrt{\frac{|a\cdot R+b\cdot C+c\cdot Rs|^2}{|a\cdot R+b\cdot C+c\cdot Rs'|^2}}$$

wherein Ls, Rs stand for the left and right surround channels, L and R stand for the left and right basic channels, C stands for the central channel, a, b and c stand for coefficients of the compatibility matrix, and Lc', Rc' stand for the compatible signals, and wherein a respective one of the compatible signals, which are produced by matricization, is weighted by a respective one of the correction factors.

11. A method of decoding the audio signals coded according to claim 10, wherein the correction factors are transmitted to the decoder, the compatible signals are divided by the correction factors; and the thus weighted compatible signals are subjected to an inverse compatibility matrix together with the signals, which were obtained by joint stere decoding of the jointly coded signal, so as to provide the left and right surround channels.

* * * * *